United States Patent [19]

Kasteler

[11] 3,995,843

[45] Dec. 7, 1976

[54] APPARATUS FOR SUPPORTING A WINDOW BUCK FRAME

[76] Inventor: Fred J. Kasteler, 1851 London Plane Road, Salt Lake City, Utah 84117

[22] Filed: Aug. 13, 1973

[21] Appl. No.: 388,053

[52] U.S. Cl. ..... 269/47; 52/127; 249/39

[51] Int. Cl.[2] ..... E04G 15/02

[58] Field of Search ..... 52/127; 269/47, 48.1, 269/52, 321 F, 321 S; 33/194; 249/39, 177

[56] References Cited

UNITED STATES PATENTS

| | | | |
|---|---|---|---|
| 2,515,977 | 7/1950 | Banneyer | 249/39 |
| 2,893,235 | 7/1959 | Goldberg | 249/39 X |
| 3,027,686 | 4/1962 | Oates | 52/127 |
| 3,166,164 | 1/1965 | Daniels | 52/127 |
| 3,403,486 | 10/1968 | Schubels | 52/127 |

*Primary Examiner*—Roy Lake
*Assistant Examiner*—Neil Abrams
*Attorney, Agent, or Firm*—B. Deon Criddle

[57] ABSTRACT

An apparatus for use in supporting a window buck frame or surround against crushing and distorting when concrete is poured therearound. An open-type reusable support frame that is inserted into a window buck frame and clamped thereto so that vertical edges of the support frame fit closely within a central ridge extending peripherally around the inside of the window buck frame. The window buck frame is aligned between wall forms, and concrete is poured around the window buck frame. After the concrete has cured and the forms are removed, the clamps are released and the support frame is pulled from the window buck frame that remains in the foundation wall.

2 Claims, 4 Drawing Figures

APPARATUS FOR SUPPORTING A WINDOW BUCK FRAME

BRIEF DESCRIPTION OF THE INVENTION

1. Field of the Invention

This invention relates to reusable supports for temporary installation within a metal window buck frame, whereby the window buck frame will not collapse when concrete is poured therearound.

2. Prior Art

It has long been recognized that in the construction of structures having windows positioned within formed concrete walls, the metal window buck frames or surrounds, if unsupported during forming of the walls, are frequently collapsed or deformed such that a window cannot be properly installed therein. In the past, it has been common for builders to reinforce such window buck frames against crushing by installing plywood panels or other wood bracing to extend between oppositely positioned window frame members. Such bracing is specially formed for each window and is usually destroyed when it is subsequently removed. While satisfactory in that they generally provide sufficient reinforcing strength to prevent buck frame collapse, these specially built forms require a great deal of time to build, cannot be reused, and usually do not allow for easy insertion therethrough of wire support ties for the concrete forms being used.

So far as I am aware, there has not heretofore been available apparatus that will brace metal window buck frames as concrete walls are formed therearound, that can be easily installed, removed and reused, and that will allow concrete support ties to be connected through the metal window buck frame.

SUMMARY OF THE INVENTION

It is a principal object of the present invention to provide a support frame dimensioned to closely fit within a window buck frame having an inwardly projecting center ridge formed around an inner periphery thereof; and whereby the window buck frame is reinforced and will not be crushed or distorted when concrete is poured around the window buck frame.

Another object is to provide an inexpensively constructed support frame that includes clamping means therewith for maintaining the support positioned against a center ridge formed peripherally inside a metal window buck frame during forming and pouring of a concrete wall around the window buck frame.

Principal features of the present invention include an angle iron support frame having one leg arranged to abut and another leg arranged to fit closely within a center ridge projecting inwardly from the periphery of a window buck frame. The support frame is of generally rectangular configuration and is made up of lengths of angle iron connected at right angles, such that the legs of each angle iron length, respectively forming base and guide legs, radiate outwardly. The legs are canted so that the outermost ends of the base legs extend further in the direction of the plane of the frame than do the outermost ends of the guide legs. The outer edges of the base legs constitute peripheral dimensions of the support, and these peripheral dimensions are slightly less than the extreme inside wall dimensions of a window buck frame in which the support frame is to be used.

In the use of the invention, the support frame slides into a window buck frame with the outer edges of its base legs traveling within the window buck frame until the outer edges of the guide legs have moved within a center ridge portion thereof, and the base legs have engaged the center ridge to prevent further support frame travel. Clamping members are then connected, preferably with bolts and wing nuts, to the guide legs, such that extensions of each clamp reach beyond the upright legs outer edges and against the center ridge on the side opposite to the engagement of the base legs with the ridge. The window buck frame center ridge is clamped between the support members base legs and the extensions of the clamps to lock the support within the window buck frame.

Braces preferably extend diagonally across the support frame corners, and a center brace extends between mid-points of the frame members serving as upper and lower horizontal members to reinforce the support frame against collapse or distortion when compressive stresses are exerted thereagainst.

Additional objects and features of the invention will become apparent from the following detailed description and drawings disclosing what is presently contemplated as being the best mode of the invention.

THE DRAWINGS

FIG. 1 is a perspective view taken from the front and one side of a window frame and support frame of the present invention, with the support frame shown exploded out of the window buck frame;

FIG. 2, a front elevation of the window of FIG. 1, with the support frame of the present invention installed therein and with a concrete wall, shown fragmentarily, formed around the window buck frame;

FIG. 3, a horizontal sectional view, taken on the line 3—3 of FIG. 2; and FIG. 4, a vertical sectional view, taken on the line 4—4 of FIG. 2.

DETAILED DESCRIPTION

Figure 1:
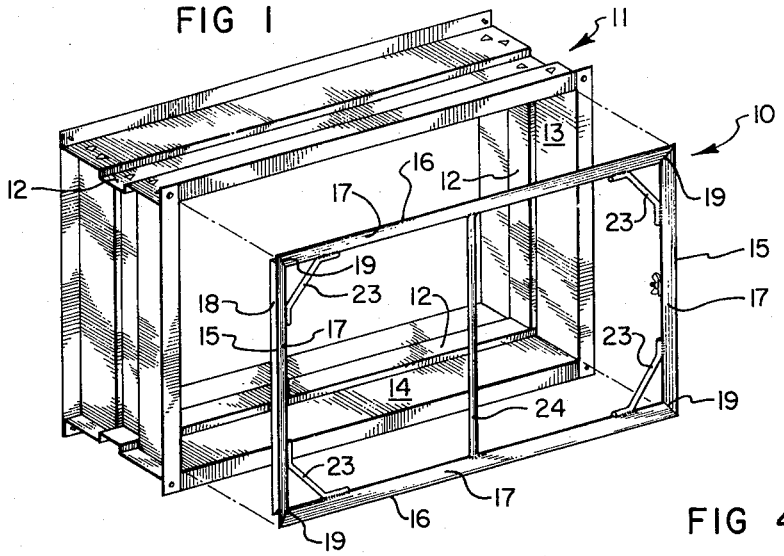
Figure 2:
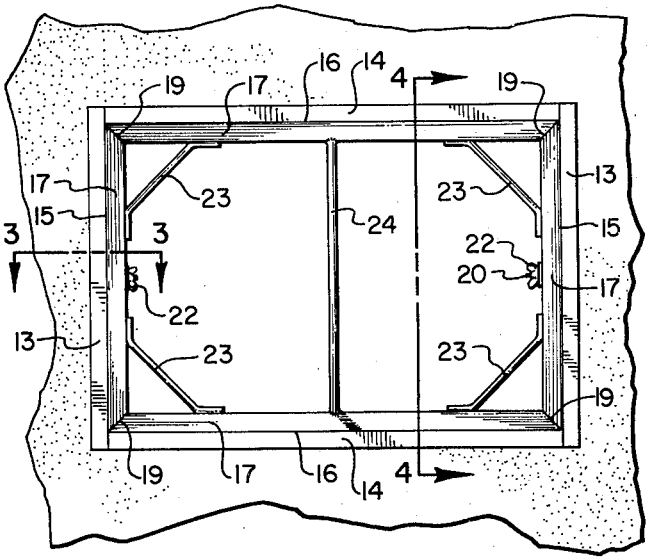
Figure 3:
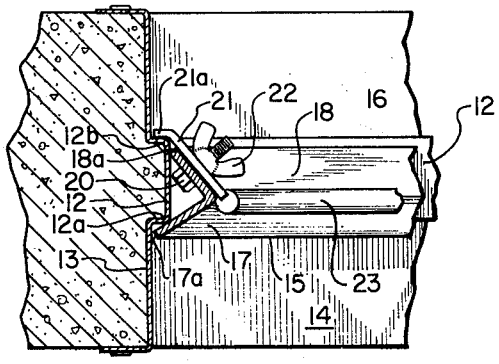
Figure 4:
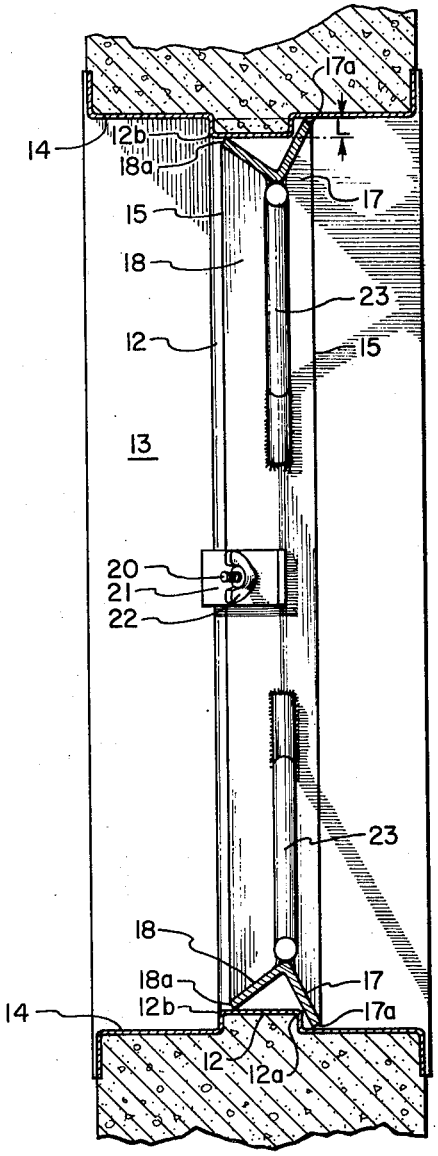

Referring now to the drawings:

In the illustrated preferred embodiment, a support frame 10 of the present invention, is shown in FIG. 1, aligned for installation within a window buck frame, shown generally at 11. The window buck frame 11 (sometimes also referred to as a "surround" since it serves to surround a window frame in the finished structure), is of conventional, commercially available, metal design, and is intended for installation in a concrete wall. A center ridge 12 that extends inwardly from the window buck frame gives the window buck frame added structural strength, but will not always prevent collapsing during forming or pouring of a concrete wall that is formed around the window buck frame. In addition, the center ridge receives concrete therein during the pour, as shown in FIGS. 3 and 4, to lock the window buck frame into the wall.

The support frame 10 is installed within the window buck frame 11 either prior to or after alignment and positioning of the window frame between concrete forms, not shown, but before concrete is poured between the forms to surround the window buck frame. The support frame 10, when installed in the window buck frame 11 reinforces the window buck frame against being crushed when concrete is poured thereon, and can easily be removed from the window buck frame after the concrete has cured and the concrete forms are removed.

The support frame 10 is constructed by connecting a pair of spaced parallel vertical members 15 with spaced, parallel horizontal members 16 as a rectangle that is arranged to fit snugly within the window buck frame 11. The support members 15 and 16 are lengths of angle iron, each having base and guide legs 17 and 18, with the corresponding legs of connected lengths being connected as at 19 to form right angles.

The vertical and horizontal support members 15 and 16 are each canted such that outer edges 17*a* and 18*a*, respectively, of the base and guide legs are spaced apart in the plane of the support frame. That is, the outer edge 17*a* of the base leg 17 extends beyond the outer edge 18*a* of the upright leg 18 and in the plane of the support, a distance L, FIG. 4, which distance is essentially the same distance that the center ridge 12 extends inwardly from the window frame flat surfaces 13 and 14. The extreme peripheral dimensions of the support 10 are therefore determined by the outer edges 17*a* of the respective base legs 17. The outer edges 17*a* are arranged to just slide within the window buck frame flat, vertical and horizontal surfaces 13 and 14, while the outer edge 18*a* of the support member guide leg 18 simultaneously moves into the space between the center ridge 12, until the base legs 17 come in contact with a raised edge 12*a* of the center ridge.

Shanks of oppositely arranged threaded bolts 20 extend through the guide legs 18 of the support members 15 to have clamps 21 loosely fitted thereover and wing nuts 22 threaded thereon. The clamps 21 are formed from flat pieces of metal having an angled end 21*a* arranged such that when the clamp is loosely fitted over the bolt shank, and the support frame is properly positioned within the window frame, the end 21*a* will engage the raised edge 12*b* of center ridge 12. When the wing nuts are tightened onto bolts 20 the angled end of the clamp is secured against the furthest center ridge edge 12*b* and the support frame is securely held in position within the window buck frame.

Braces 23, extending diagonally between interconnected support members 15 and 16 at each corner of the support frame, provide rigidity to the support frame and distribute loads placed thereon.

Further reinforcing of the support frame 10 against collapse is provided by a straight post 24 located between the mid-points of the opposite vertical and horizontal support members 15 and 16. It should be understood that, as desired, one or more additional support posts, not shown, could be installed between the vertical support members 15 to reinforce the support 10 against being crushed by stress forces exerted against the spaced vertical support members should this be found desirable.

The corner reinforcing members 23 and the post 24 are preferably formed from sections of reinforcement bar cut and bent appropriately to be welded or otherwise affixed to the vertical and horizontal support members 15 and 16.

Because the support frame is open between the support members making up the rectangular frame and the support braces, forming ties, interconnecting concrete forms covering opposite faces of the support frame can be readily passed through the support frame. This, of course, is not possible when solid-type forms are used.

Although a preferred form of my invention has been herein disclosed, it is to be understood that the present disclosure is made by way of example and that variations are possible without departing from the subject matter coming within the scope of the following Claims, which subject matter I regard as my invention.

I claim:

1. A support frame for installation in a window buck frame that has a center ridge extending peripherally into a window opening thereof, said support frame comprising pairs of spaced apart vertical and spaced apart horizontal structural support members connected to form a rectangle having outermost peripheral dimensions just smaller than the inside window opening dimensions of said window buck frame, and larger than the inside dimensions of the center ridge of the window buck frame, the area between said vertical and horizontal structural members being sufficiently open to allow form ties to be passed therethrough; and means for releasably clamping said formed rectangle to said center ridge, inside said window buck frame, said means comprising clamp means connected to one of the support members and having a leg extending therefrom to reach over the center ridge and means for releasably tightening the leg means to the support member and against the ridge means.

2. A support frame as recited in claim 1, further including reinforcing means comprising a diagonal brace extending across each corner of the rectangle and between the vertical and horizontal support members; and a post extending between mid-points of the horizontal support members.

* * * * *